US006877637B2

(12) United States Patent
Allanson et al.

(10) Patent No.: US 6,877,637 B2
(45) Date of Patent: Apr. 12, 2005

(54) SELF-SEALING DISPENSING TAP FOR FLEXIBLE PACKAGES

(75) Inventors: Gary R. Allanson, Crownsville, MD (US); Joseph E. Koehler, Scituate, MA (US); Joseph DiMatteo, Billerica, MA (US)

(73) Assignee: International Dispensing Corp., Hanover, MD (US)

( * ) Notice: Subject to any disclaimer, the term of this patent is extended or adjusted under 35 U.S.C. 154(b) by 97 days.

(21) Appl. No.: 10/376,058

(22) Filed: Feb. 27, 2003

(65) Prior Publication Data

US 2003/0226855 A1 Dec. 11, 2003

Related U.S. Application Data

(60) Provisional application No. 60/360,238, filed on Feb. 27, 2002.

(51) Int. Cl.[7] ..... B67D 5/00
(52) U.S. Cl. ..... 222/90; 222/83
(58) Field of Search ..... 222/83, 90

(56) References Cited

U.S. PATENT DOCUMENTS 1,636,135 A * 7/1927 Hughes ..... 222/90
2,267,159 A * 12/1941 Lopes, Jr. ..... 222/90
2,975,938 A * 3/1961 Marfisi ..... 222/90
3,184,107 A * 5/1965 Kohanzo ..... 222/90
3,460,715 A * 8/1969 Jones et al. ..... 222/90
4,417,672 A 11/1983 Eppenbach ..... 222/81
5,884,810 A 3/1999 Vizcarra et al. ..... 222/83
6,082,584 A 7/2000 Stern ..... 222/83

* cited by examiner

*Primary Examiner*—Philippe Derakshani

(74) *Attorney, Agent, or Firm*—Whiteford, Taylor & Preston LLP; Jeffrey C. Maynard; Gregory M. Stone

(57) ABSTRACT

Disclosed is a self-sealing dispensing tap for use on flexible packages. The tap includes a piercing end configured for piercing the wall of a flexible container, and a flexible member that rides along the tap as it is inserted into the container and expands once installed so as to prevent its withdrawal from the container. A clamping device is provided on the outside of the container which draws the flexible member against the interior wall of the container so as to provide a barrier preventing product within the container, bacteria, or oxygen from inadvertently passing between the interior and exterior of the container.

32 Claims, 10 Drawing Sheets

SELF-SEALING DISPENSING TAP FOR FLEXIBLE PACKAGES

CROSS-REFERENCE TO RELATED APPLICATIONS

This application is based upon and gains priority from U.S. Provisional Patent Application Ser. No. 60/360,238, entitled "Self-Sealing Dispensing Tap for Flexible Packages", filed with the U.S. Patent and Trademark Office on Feb. 27, 2002 by the inventors herein, the specification of which is incorporated herein by reference.

BACKGROUND OF THE INVENTION

1. Field of the Invention

The invention disclosed herein relates generally to dispensing taps, and more particularly to a self-sealing dispensing tap for use on flexible packages.

2. Description of the Background

It is known to provide liquid products, and more particularly consumable liquid products (e.g., milk, juices, sauces, etc.), in soft sided pouches or bags. Typically, such containers are initially formed in planar sheets, often comprised of layers of paper and thermoplastic, and are thereafter formed into the desired container shape, filled with the intended product, and sealed as a closed package. After the container is filled and sealed, it may be provided with a dispensing outlet, such as by adhesively securing the dispensing outlet to a portion of the container that may later be torn open by the user to provide access to the product stored inside. For this purpose, a weakened zone may be provided in the packaging material enabling a user to break through the packaging once the dispensing outlet has been moved to an open position.

Notably, it has been necessary to apply such dispensing outlets to the packaging after the planar package has been formed, and particularly in the predetermined location of the weakened zone of packaging that is intended to be pierced by the user. Unfortunately, such flexible packages typically have not been provided fitments or outlets embedded into the packaging structure, as the planar laminate packaging material has lacked the structural integrity to support such fitments, and because the typical filling equipment ordinarily used in conjunction with filling such containers will not accommodate external fitments in the filling process. As a result, this type of flexible package offers end-users limited benefits and has limited applications.

More particularly, once such a container is opened, a user will typically lift the container as they would a pitcher and pour the liquid from the container through the dispensing outlet. While such configuration has been generally acceptable for individual consumers who need to dispense only a small quantity of product at a time, it has not proven useful for foodservice applications which often require dispensing of larger quantities of liquid and which often use dispensing apparatus to assist in the dispensing process. Prior known flexible containers to which an external dispensing outlet is adhesively applied in a set location have not proven conducive to incorporation in commercial dispensing apparatus, and would in fact require a fitment enabling connection to such apparatus if they were to be used in commercial applications, but the lacking structural integrity of the container structure has prevented the incorporation of such a feature. It would therefore be highly beneficial to provide a fitment that could be applied to such a flexible container after the container has been filled and sealed, which does not have to be embedded in the container structure during the manufacturing process, and which fitment would enable connection to dispensing apparatus quickly, safely, and securely.

SUMMARY OF THE INVENTION

The present invention provides a self-sealing dispensing tap configured for connection to flexible pouches or soft-sided packages, which self-sealing dispensing tap serves as an anchor, seal, and passageway to a dispensing apparatus once the tap is positioned on the side wall of the flexible pouch or package. The self-sealing tap is configured to pierce the laminated sidewall structure of a typical flexible liquid pouch or package, including but not limited to laminated pouch or package configurations, and firmly seals itself to the sidewall of the pouch or package. The tap is configured to provide a strong seal inside and out of the pouch or package, such that the tap will withstand pressures on the interior of the package without allowing the seals around the tap to break or leak. Such a sealed configuration prevents product from leaking out of the package, and likewise prevents oxygen or bacteria from seeping into the package.

DESCRIPTION OF THE DRAWINGS

The features, aspects, and advantages of the present invention are considered in more detail, in relation to the following description of embodiments thereof shown in the accompanying drawings, in which.

DETAILED DESCRIPTION OF THE PREFERRED EMBODIMENTS

The invention summarized above and defined by the enumerated claims may be better understood by referring to the following description, which should be read in conjunction with the accompanying drawings in which like reference numbers are used for like parts. This description of an embodiment, set out below to enable one to build and use an implementation of the invention, is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
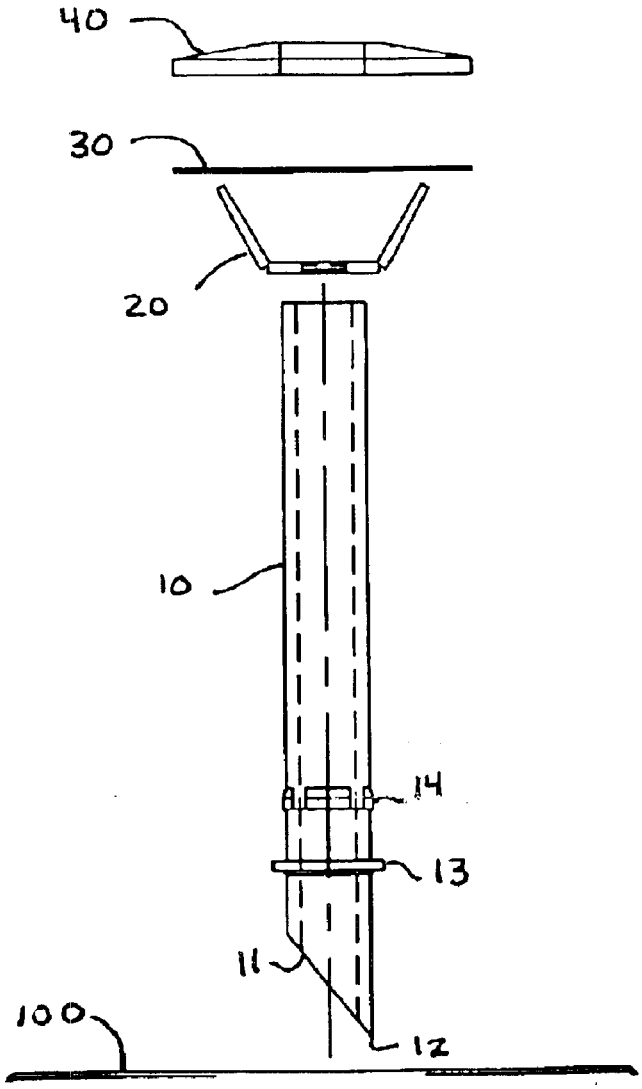
FIG. 1 is an exploded view of a dispensing tap according to a first embodiment of the instant invention.

As shown in FIG. 1, a first embodiment of a self-sealing dispensing tap according to the instant invention provides an elongate tube 10 comprised of FDA-approved plastic material that is selected for its ability to withstand an irradiation process of up to 5.0 Mrads and temperatures of 260° F. (e.g., a polypropylene copolymer). In the exemplary embodiment of FIG. 1, elongate tube 10 is a hollow tube approximately ⅝" in diameter and approximately 3" to 4" in length, although such dimensions may be modified to a larger or smaller dimension in order to mate with pumping and dispensing apparatus as explained in greater detail below without departing from the spirit and scope of the instant invention. A penetrating end of elongate tube 10 is provided at least one angled face 11 defining a piercing tip 12. Given such construction, when elongate tube 10 is pressed against the wall of a flexible container 100, piercing tip 12 may pierce the flexible wall of container 100, and further inward pushing of elongate tube 10 will result in its insertion into container 100.

Elongate tube 10 may be provided a hinge stop 13 encircling the exterior wall of tube 10 near its angled face 11. Hinge stop 13 is preferably configured as a ring rigidly attached to tube 10, and is most preferably formed in one piece with tube 10.

Elongate tube 10 may also be provided a lock ring stop 14 positioned an axial distance away from hinge stop 13 on the side of hinge stop 13 opposite angled face 11. Lock ring stop 14 is preferably configured as a ring rigidly attached to tube 10, and is most preferably formed in one piece with tube 10. As shown in the exemplary embodiment of FIG. 1, lock ring stop 14 may optionally be segmented along its circumference to ease the application of a lock ring (as discussed in greater detail below).

Figure 2:
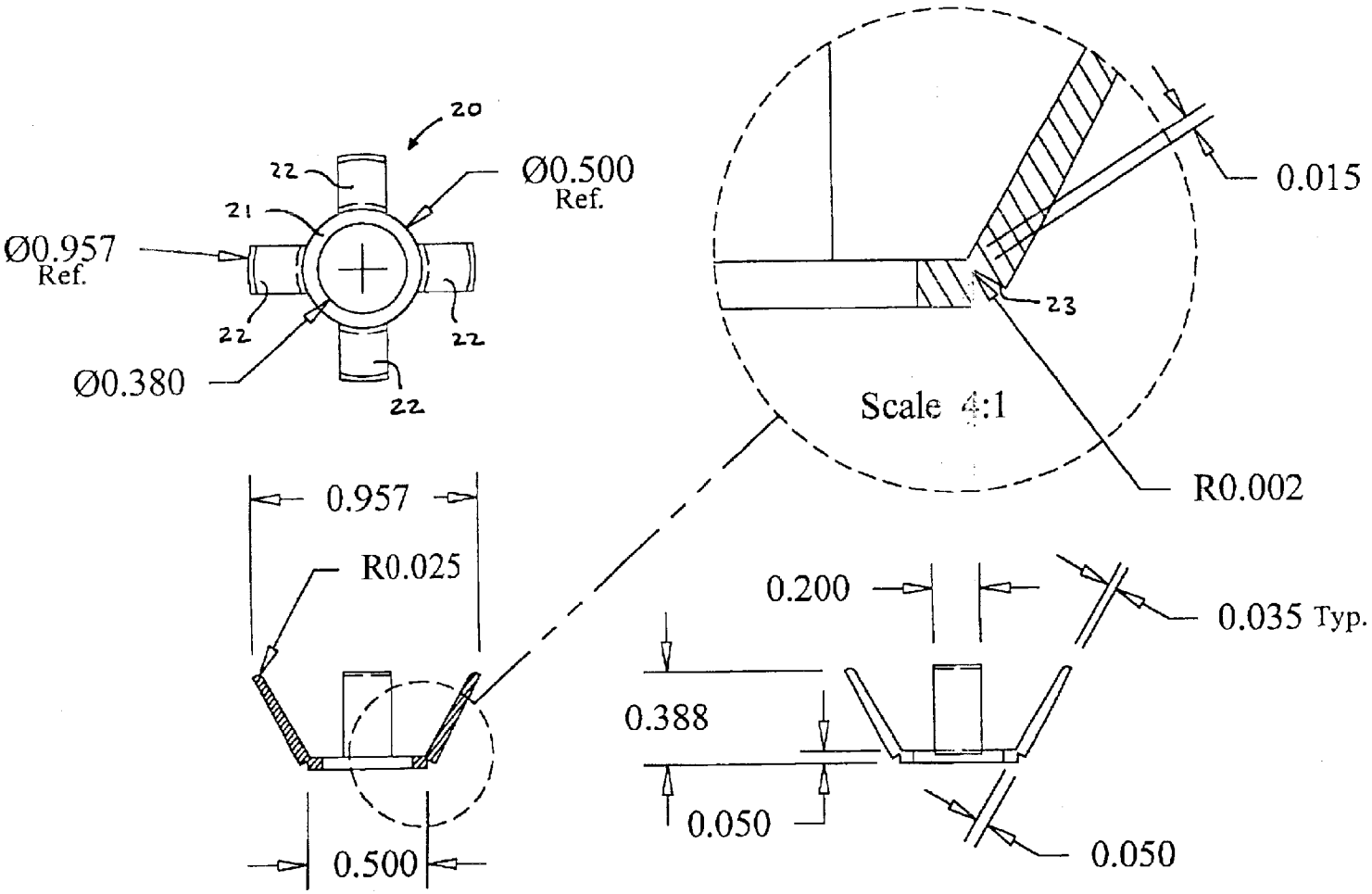
FIG. 2 is a top, side, and sectional view of the hinge plate shown in FIG. 1.

The first embodiment of the self-sealing dispensing tap of FIG. 1 also includes a hinge plate 20. As shown more particularly in FIG. 2, hinge plate 20 comprises a central ring plate 21 having an inner diameter sized to allow application of hinge plate 20 over elongate tube 10. It should be noted that the dimensions shown in FIG. 2 are exemplary only and not intended to limit the configuration of the dispensing tap of the instant invention in any way. As discussed in greater detail below, during assembly, hinge plate 20 may be forced over lock ring stop 14 and is ultimately positioned against hinge stop 13. Hinge plate 20 is preferably formed from polypropylene or similarly configured plastic material that will allow hinge plate 20 to deform momentarily as it is brought to its final position against hinge stop 13. In this first embodiment, the diameter of tube 10 at least at the location immediately above hinge stop 13 is preferably greater than the inner diameter of hinge plate 20, thus providing a tight fit between hinge plate 20 and tube 10 so as to prevent hinge plate 20 from moving with respect to tube 10 as it penetrates a package. Affixed to the outer circumference of ring plate 21 is a plurality of hinge fingers 22. Each hinge finger 22 is attached to the outer circumference of ring plate 21 to allow pivotal movement between the fingers 22 and ring plate 21. For example, the hinge fingers 22 may be attached to the outer circumference of ring plate 21 only along approximately the top 30% of the end wall 23 of each hinge finger 22, with the remainder of the end wall 23 being detached from the outer circumference of ring plate 21. Hinge plate 20 is preferably formed with sufficient flexibility so that each hinge finger 22 may be pivoted with respect to central ring plate 21 along the portion of its end wall 23 that joins with ring plate 21. When pivoted downward, the end wall 23 of each hinge finger 22 may rest against the outer circumferential wall of ring plate 21, and the top face of each hinge finger 22 lies generally parallel to the top face of ring plate 21.

While FIG. 2 particularly denotes four hinge fingers 22 on hinge plate 20, additional or fewer hinge fingers 22 of varying widths and dimensions may likewise be provided without departing from the spirit and scope of the invention.

The first embodiment of the self-sealing dispensing tap of FIG. 1 also preferably includes a thermoplastic elastomer (e.g., silicone) seal 30 formed as a disc having a centrally located opening configured with an opening diameter that is preferably smaller than the outer diameter of elongate tube 10 so as to eliminate radial leakage of fluid between seal 30 and tube 10. Because seal 30 is formed of a flexible thermoplastic elastomer material, it may be easily slid along elongate tube 10 and elastically deformed as it is pulled over lock ring stop 14. However, once seal 30 is pulled over lock ring stop 14, it returns to its original shape so as to lie flush against the outer wall of elongate tube 10 so as to provide a barrier preventing product within container 100, bacteria, or oxygen from passing between seal 30 and the exterior of elongate tube 10.

Lastly, the first embodiment of the self-sealing dispensing tap of FIG. 1 includes a lock ring 40, which is preferably formed of a rigid thermoplastic, such as a polycarbonate or an acetyl. As with thermoplastic resin seal 30, lock ring 40 is formed of a disc having a centrally located opening configured with an opening diameter approximating the outer diameter of elongate tube 10. During installation, lock ring 40 is slid along elongate tube 10 and is forced over lock ring stop 14. Lock ring 40 may be formed with sufficient resiliency that it may be temporarily deformed as it passes over lock ring stop 14. However, once lock ring 40 is pulled over lock ring stop 14, it returns to its original shape so as to lie flush against the outer wall of elongate tube 10.

In order to aid in the installation of thermoplastic resin seal 30 and lock ring 40 onto elongate tube 10, lock ring stop 14 may be provided with an angled face at its upper end and a right-angle stop at its bottom end. Such configuration aids directing both seal 30 and lock ring 40 over stop 14, but renders removal in the opposite direction much more difficult as a result of the right-angle stop at its bottom end.

Figure 3:
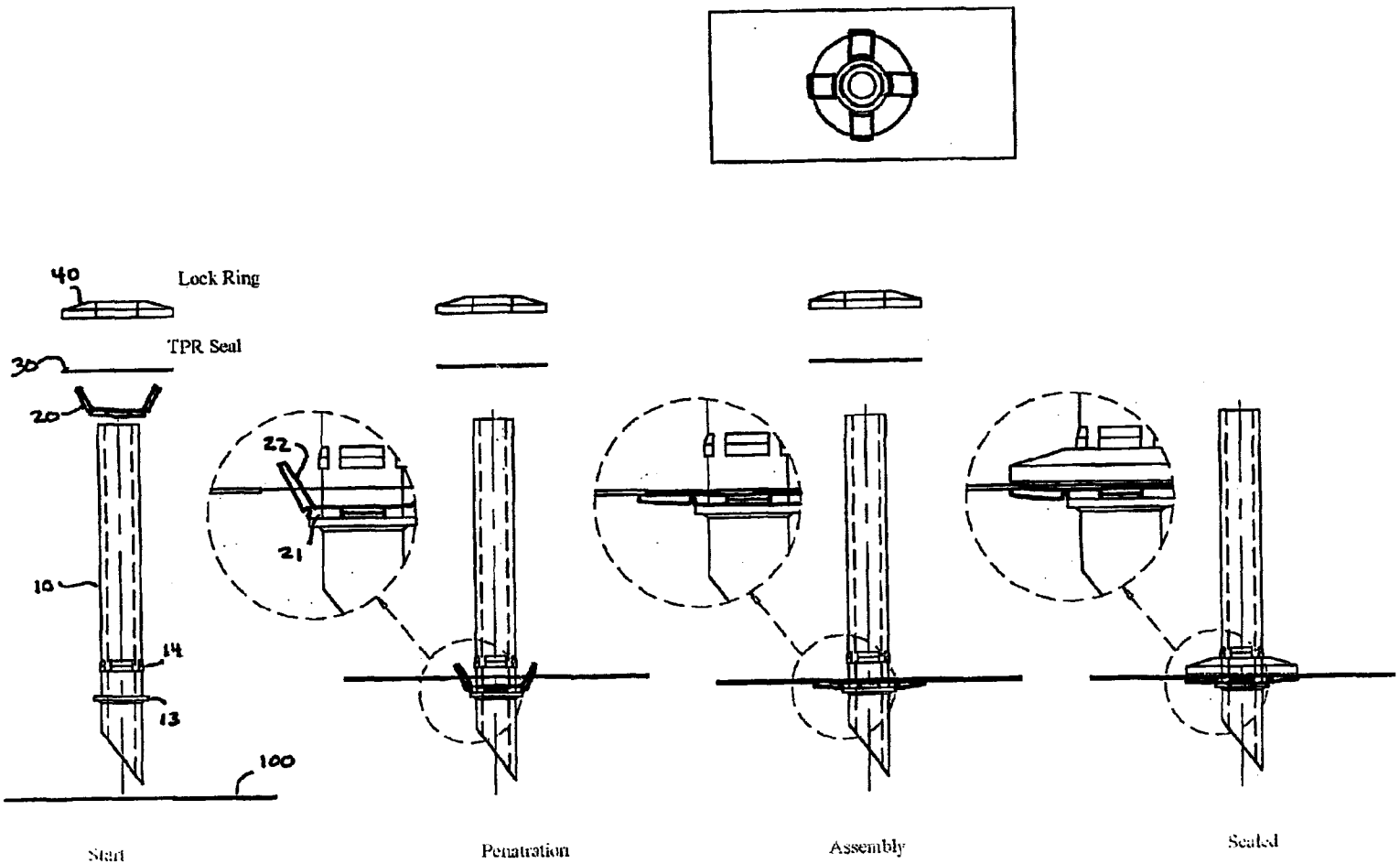
FIG. 3 is a schematic view showing the installation of the tap of FIG. 1 onto a container.

As shown in FIG. 3, the first embodiment of the self-sealing dispensing tap of FIG. 1 is attached to a flexible container 100 as follows. First, hinge plate 20 is positioned on elongate tube 10 so that its bottom face rests against the top face of hinge stop 13. Next, the piercing tip 12 of angled face 11 of tube 10 is pressed against the outer wall of a flexible container, and is thereafter forced inside of the flexible container. As tube 10 is directed through the exterior wall of container 100, it likewise carries hinge plate 20 into flexible container 100. Tube 10 is continuously directed into container 100 until the outermost portion of hinge fingers 22 are able to pivot downward without interference from the wall of flexible container 100. At this point, tube 10 is pulled in the opposite direction (i.e., towards the exterior of container 100), causing the outermost portions of each hinge finger 22 to abut the interior wall of container 100. As tube 10 is pulled further in the opposite direction, hinge fingers 22 continue to bend downward until they reach a position generally parallel to central ring plate 21. In this configuration, hinge plate 20 essentially serves as a clamp preventing the further withdrawal of tube 10 from container 100.

Next, thermoplastic elastomer seal 30 is pushed downward along tube 10 and over lock ring stop 14 until it is positioned flush against the exterior wall of container 100. Thereafter, lock ring 40 is likewise pushed downward along tube 10 and over lock ring 14 until it is positioned flush against seal 30. Preferably, lock ring 40, seal 30, hinge plate 20, and the axial distance between hinge stop 13 and lock ring stop 14 are dimensioned such that when hinge plate 20 is flush against the interior wall of container 100, lock ring stop 14 clamps lock ring 40 against seal 30 so as to form a seal that is sufficiently tight to prevent product within container 100, bacteria, or oxygen from passing between the interior and exterior of container 100.

Once the self-sealing dispensing tap of FIG. 1 is seated in container 100, dispensing tubing attached to, for example, a dispensing pump or other dispensing apparatus (not shown) may be attached to the free end of elongate tube 10 so as to enable dispensing of the product contained within flexible container 100.

Figure 4:
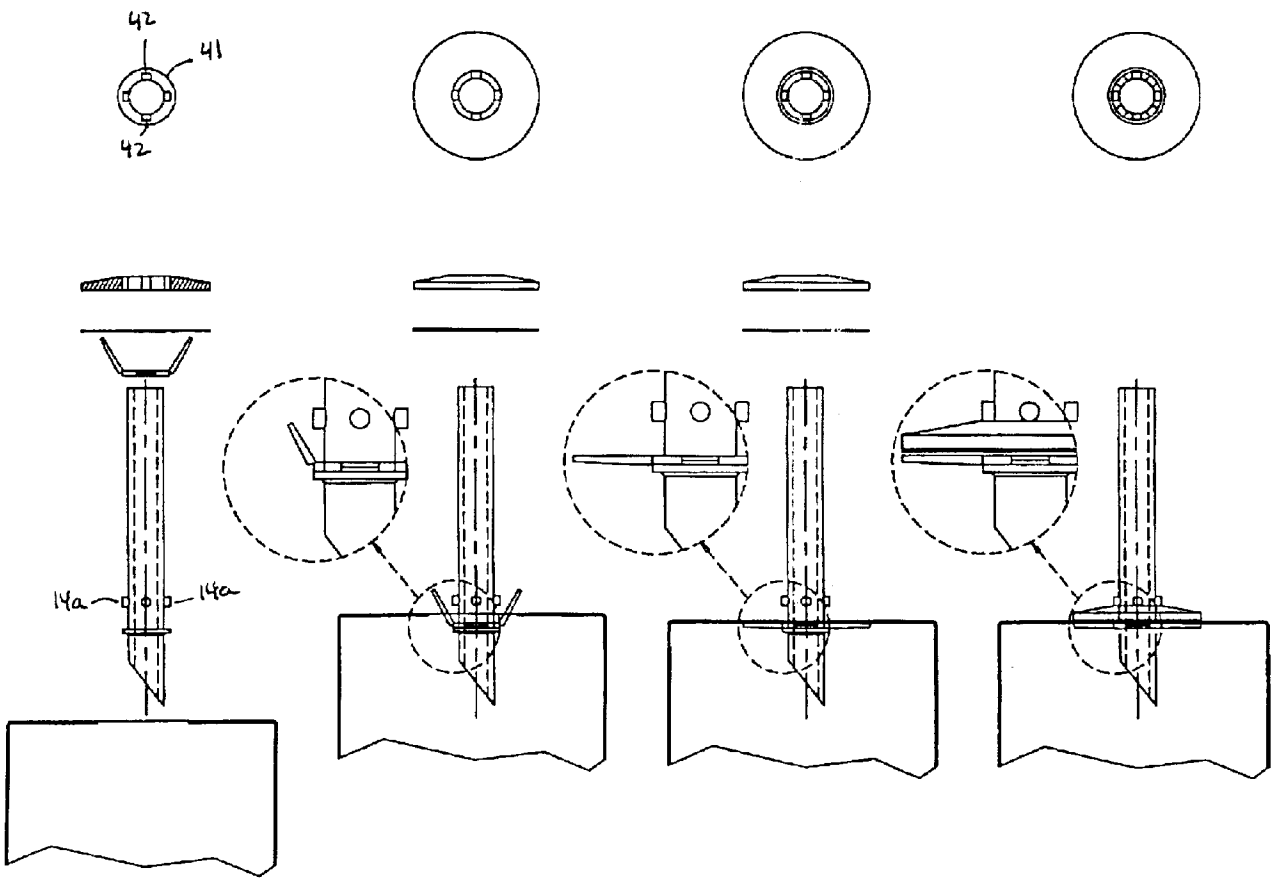
FIG. 4 is a schematic view showing the installation of a dispensing tap according to a first alternate embodiment of the invention.

In a first alternate embodiment, lock ring stop 14 may be modified as shown in FIG. 4. More particularly, lock ring stop 14 may be configured as a plurality of protrusions 14*a* extending radially outward from the center of tube 10 and circumferentially aligned along the exterior wall of tube 10. Moreover, lock ring 40 is fitted at its center opening with a disk 41 having a plurality of radial slots 42 extending into the interior wall of disk 41. Slots 42 are preferably sized so as to allow the combined assembly of lock ring 40 and disk 41 to be passed over lock ring stop 14 when slots 42 and protrusions 14*a* are axially aligned. Once the combined assembly of lock ring 40 and disk 41 have passed over lock ring stop 14, lock ring 40 may be pressed towards the exterior wall of container 100 and rotated about the central axis of tube 10 so as to misalign protrusions 14*a* and slots 42, thus preventing lock ring 40 from traveling upward along tube 10, and in turn setting the compression on the sealing assembly.

Figure 5:
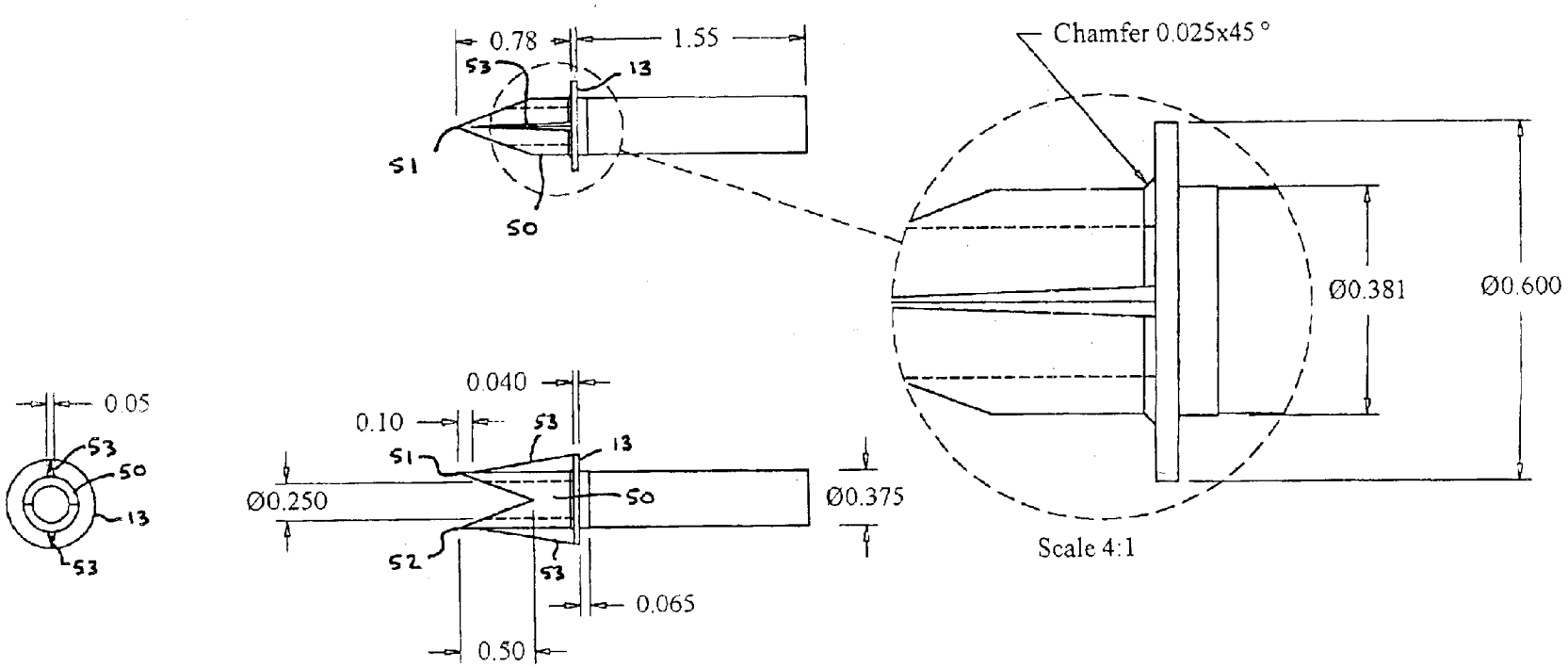
FIG. 5 is a top, side, and front view of an alternate embodiment of the tube of FIG. 1.

In a second alternate embodiment, the piercing tip of elongate tube 10 may be modified as shown in FIG. 5. More particularly, as shown in the top and side views of FIG. 5, the piercing tip is formed from a cylindrical wall 50 having sharpened edges 51 and 52, and knife edges 53 extending along the top and bottom portions of cylindrical wall 50 in a direction generally parallel to the major axis of tube 10, the radial dimension of each knife edge diminishing as they approach the free ends of sharpened edges 51 and 52. The back end of the alternate piercing tip configuration shown in FIG. 5 is provided hinge stop 13, serving the same function as hinge stop 13 in the embodiment of FIG. 1. Moreover, while not particularly shown in FIG. 5, elongate tube 10 would again be provided lock ring stop 14, and the self-sealing dispensing tap using the piercing head of FIG. 5 would likewise include hinge plate 20, thermoplastic resin seal 30, and lock ring 40, all as discussed above with regard to the embodiment shown in FIG. 1.

Figure 6:
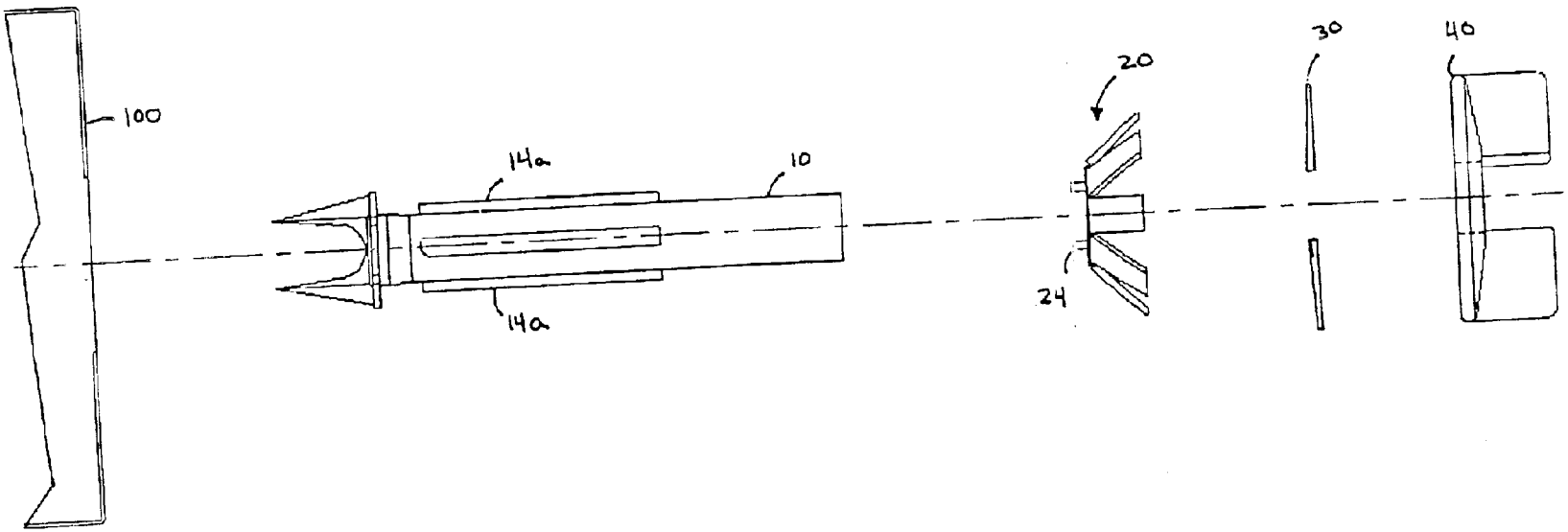
FIG. 6 is an exploded view of a dispensing tap according to another alternate embodiment of the instant invention.

In a third alternate embodiment, elongate tube 10, hinge plate 20, and locking ring 40 may be further modified as shown in FIG. 6, wherein alignment pins 24 are provided to hold hinge plate 20 in a fixed angular position with respect to elongate tube 10 when it is installed thereon, and wherein radial protrusions 14*a* are provided in the form of elongate ribs extending along the length of elongate tube 10 and parallel to its major axis.

Figure 7:
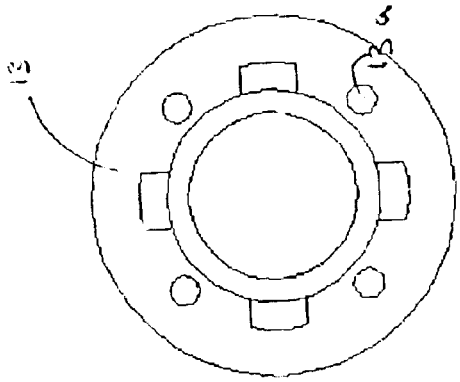
FIG. 7 is top, side, and front view of the tube of FIG. 6.
Figure 7:
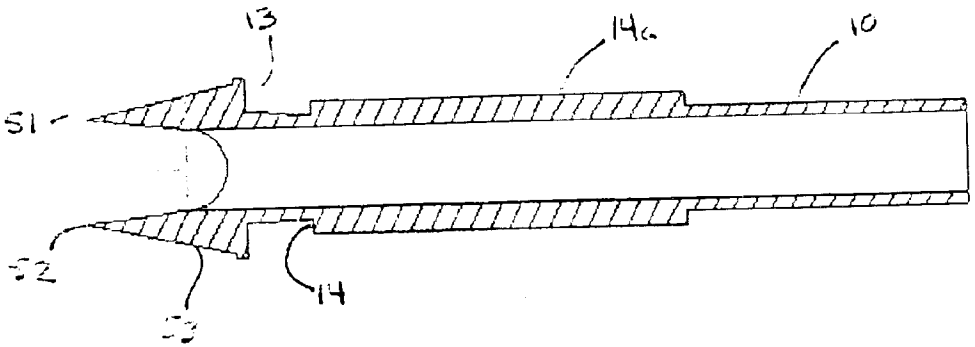
Figure 7:
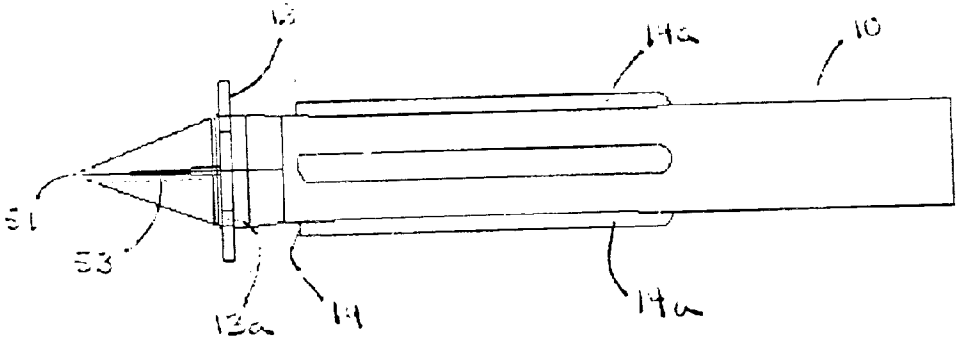

As shown in FIG. 7, elongate tube 10 is provided in such third embodiment with sharpened edges 51 and 52 and knife edges 53 enabling the piercing tip of elongate tube 10 to pierce the sidewall of a flexible container, hinge stop 13 to fix the position of hinge plate 20, and locking ring stop 14 formed by the ends of elongate radial protrusions 14*a*. In this embodiment, hinge stop 13 is provided a plurality of openings 13*a* configured to receive pins 24 (FIG. 6) extending from the bottom of hinge plate 20 such that when hinge plate 20 is fully installed on elongate tube 10, its angular orientation is fixed with respect to elongate tube 10. Further, hinge stop 13 is preferably positioned an axial distance away from ring stop surface 14 on protrusions 14*a* to allow sufficient space there between to receive hinge plate 20, thermoplastic ring seal 30, lock ring 40, and the wall of container 100, and hold the same against one another in a sealing engagement.

Figure 8:
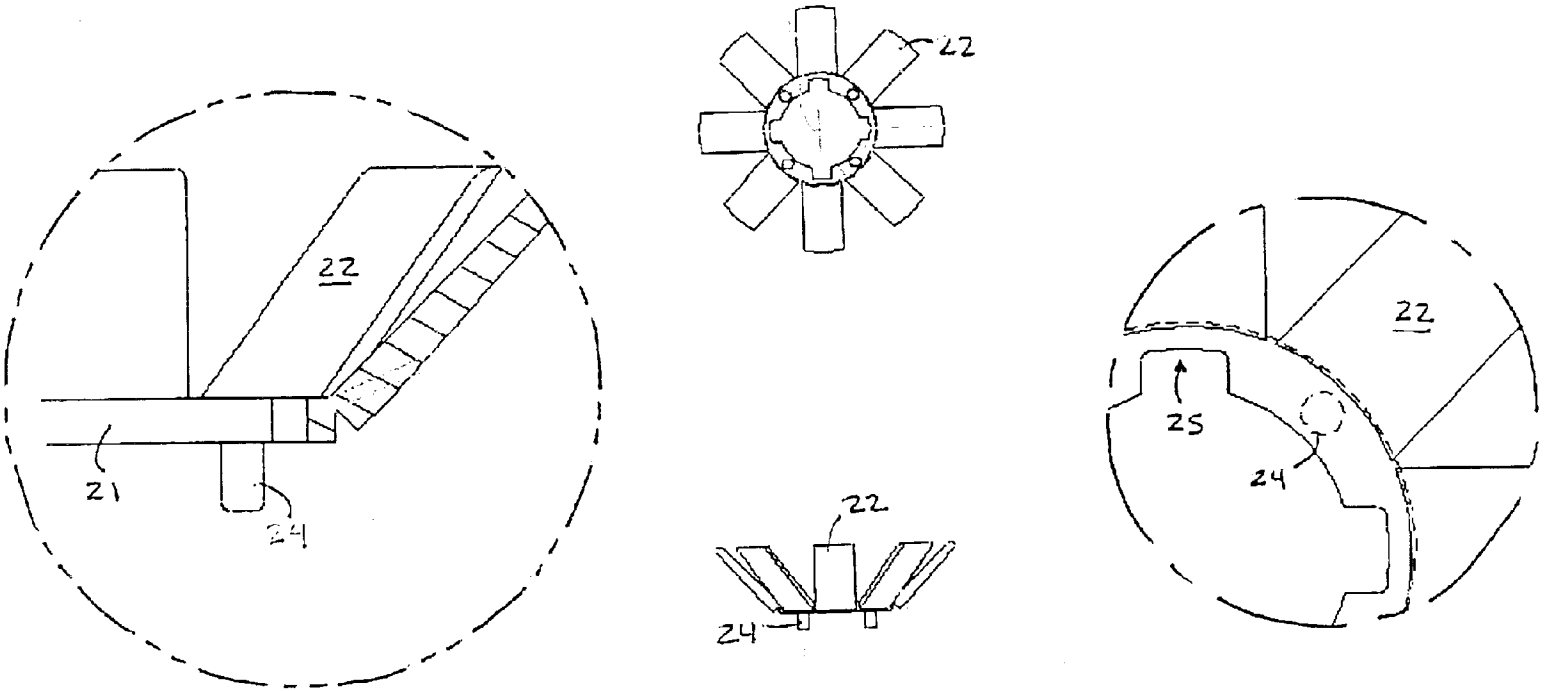
FIG. 8 is a top, side, and sectional view of the hinge plate shown in FIG. 6.

As shown in FIG. 8, the hinge plate in this embodiment is again provided a plurality of hinge fingers 22 extending from ring plate 21. Extending from the bottom of ring plate 21 are one or more pins 24 configured for insertion into openings 13*a* of hinge stop 13, as discussed above. Ring plate 21 is also preferably provided openings 25 enabling hinge plate 20 to be inserted on elongate tube 10 while being guided by elongate radial protrusions 14*a*, such that when hinge plate 20 reaches hinge stop 13, pins 24 are aligned with openings 13*a* enabling easy seating of hinge plate 20 against hinge stop 13.

Figure 9:
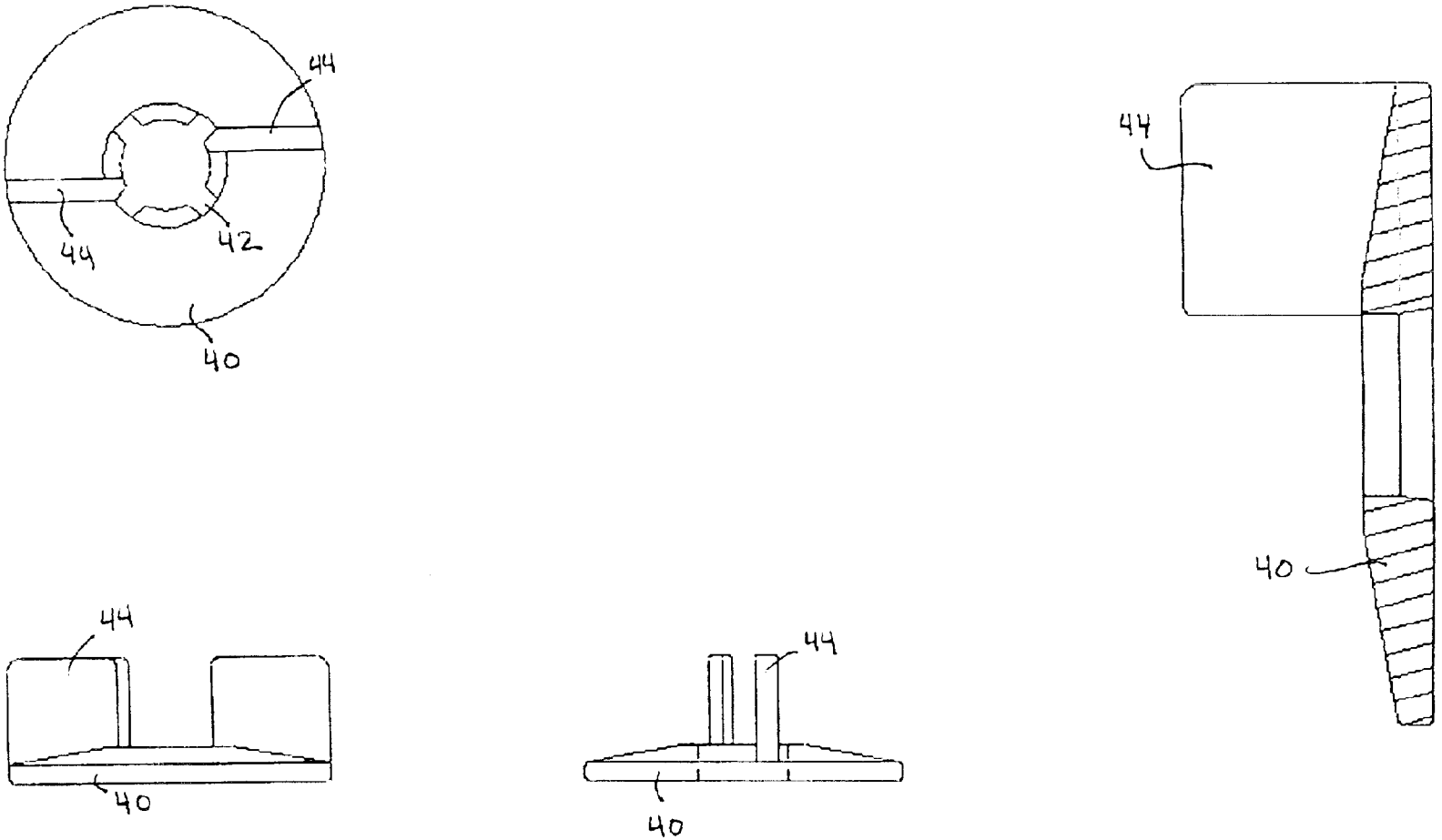
FIG. 9 is a top, side, and sectional view of the lock ring shown in FIG. 6.

Likewise, as shown in greater detail in FIG. 9, lock ring 40 in this embodiment is again provided openings 42 enabling lock ring 40 to be inserted over elongate tube 10 and to travel along its length towards lock ring stop surface 14. One or more tabs 44 preferably extend upward from the top face of lock ring 40. Thus, when lock ring 40 has traveled the length of elongate tube 10 and clears lock ring stop surface 14, a user may use tabs 44 to turn lock ring 40 to misalign openings 42 and elongate protrusions 14*a*, thus preventing lock ring 40 from traveling back up elongate tube 10, and further clamping thermoplastic ring seal 30 against the outer surface of container 100.

Figure 10:
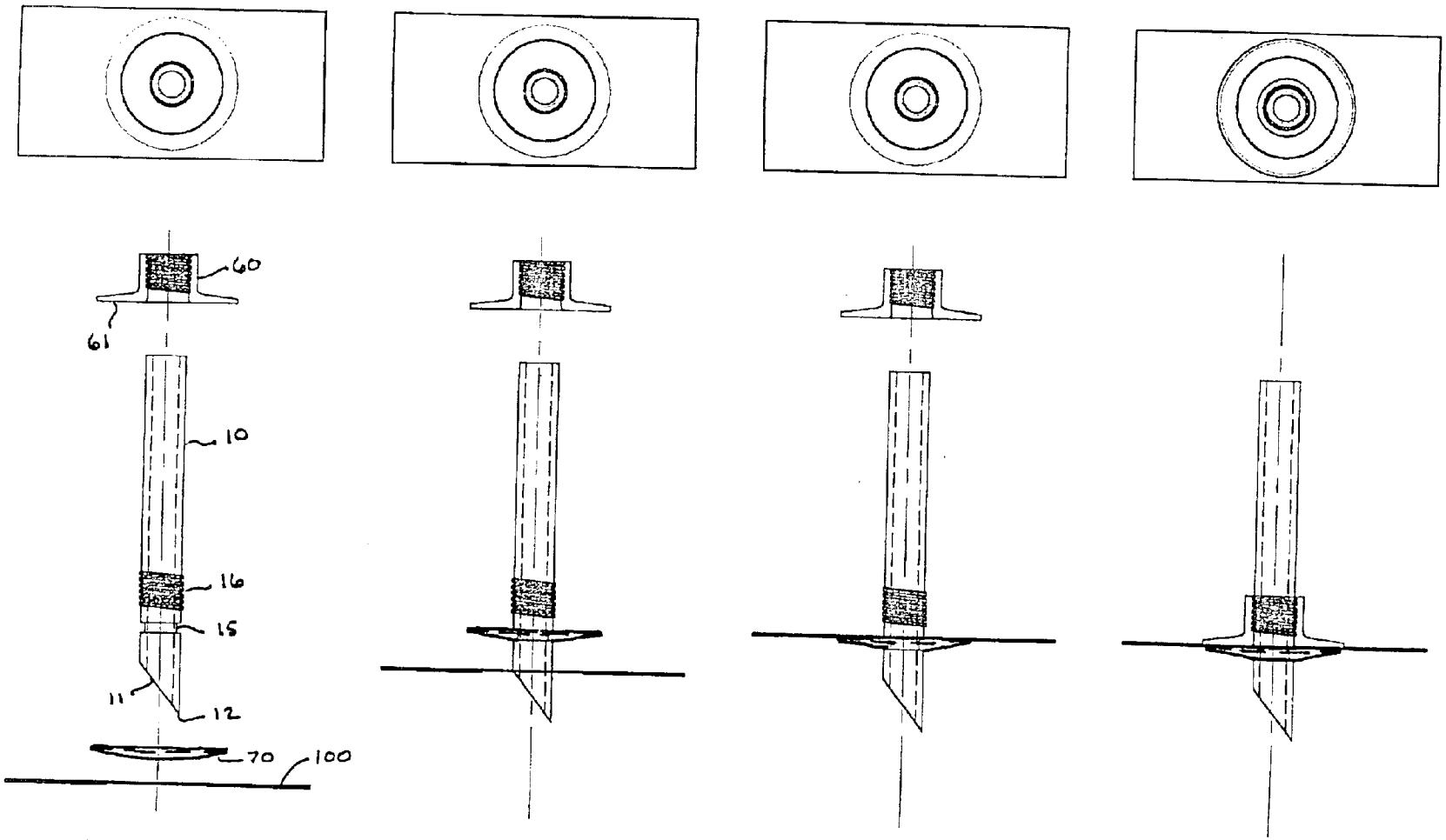
FIG. 10 is a schematic view showing the installation of a dispensing tap according to yet another alternate embodiment of the instant invention.

In a fourth alternate embodiment, the self-sealing dispensing tap may be modified as shown in FIG. 10. In this case, elongate tube 10 is again provided an angled face 11 having a piercing tip 12 as set forth above with regard to the embodiment shown in FIG. 1, although the piercing tip may likewise assume the configuration of the other embodiments described herein. However, positioned a short distance away from angled face 11 along the body of tube 10 is a section of reduced outer diameter 15 which defines an indentation along the body of tube 10. Reduced outer diameter section 15 is preferably provided an axial length that approximates the maximum width of an umbrella-shaped, flexible, silicone seal 70. Silicone seal 70 is provided a central opening having a diameter that approximates the outer diameter of reduced outer diameter section 15 along the body of tube 10. As seal 70 is a generally flexible member, the central opening in seal 70 may be elastically expanded so that seal 70 may be slid along the body of tube 10 until it fully rests within the indentation of reduced outer diameter section 15. However, as both the upper and lower edges of reduced diameter section 15 provide right-angle stops, inadvertent movement of seal 70 out of the indentation formed by reduced diameter section 15 is avoided.

Positioned adjacent reduced diameter section 15 on the exterior wall of tube 10 are external threads 16. External threads 16 are configured to receive internally threaded clamp ring 60. Clamp ring 60 comprises a generally cylindrical, hollow wall having threads on its interior, and a clamping face 61 extending radially outward from the cylindrical wall.

In use, the self-sealing dispensing tap of FIG. 10 is positioned adjacent the wall of a flexible container 100, and seal 70 is slid along the body of elongate tube 10 until it rests in the indentation formed by reduced diameter section 15. Elongate tube 10 is then inserted into container 100 using piercing tip 12 to pierce the wall of container 100, and is pressed inward. As tube 10 is inserted into container 100, it pulls seal 70 through the wall. Because seal 70 is flexible, the outer portions of seal 70 fold upward and inward as it is pulled through the wall of container 100, until such time as the outermost edges of seal 70 clear the interior wall of container 100. At that point, the resiliency of seal 70 causes it to unfold to its original, flat position, thus forming a sealing face against the interior wall of container 100. Clamp ring 60 is then threaded onto elongate tube 10. As clamp ring 60 is tightened, it tends to pull tube 10 outward from container 100, in turn providing a clamping force to compress seal 70 tightly against the interior wall of container 100. As with each of the other embodiments discussed herein, once the self-sealing tap of FIG. 10 is thus installed, the free, exposed end of the tap may be connected to dispensing apparatus tubing to allow for the dispensing of the contents of container 100.

It should be noted that with regard to each of the above-disclosed embodiments, the self-sealing dispensing tap is configured to provide a commercially sterile connection between dispensing apparatus and the interior of container 100, in which neither side of the connection will be able to introduce microbial contamination into the contents of container 100. In order to achieve a sterile connection, all components of the self-sealing dispensing tap may be provided in a single sterile package with the sealing components pre-positioned on tube 10. For example, the tap shown in FIG. 1 may be provided in a single sterile package with hinge plate 20 already positioned against hinge stop 13, and with seal 30 and lock ring 40 seated on tube 10 at the non-piercing end. Likewise, the tap shown in FIG. 5 may be provided in a single sterile package with seal 70 seated on tube 10 at reduced diameter section 15, and with clamp ring 60 seated on tube 10 at the non-piercing end. When used, a user may simply expose the piercing tip of elongate tube 100 (such as by tearing open only a portion of the package in which the tap is shipped to the user), and while grasping the opposite end of the tube through its packaging, insert the sterile piercing end through the wall of the container until the particular flexible member is seated against the interior wall of the container. A sterile, peel-away covering may optionally be provided over a portion of the exterior wall of container 100, such that a clean, sterile surface may be exposed at only such time as the package is ready to be tapped. Once the piercing end of the tap is seated on the interior of container 100, the appropriate clamping assembly may simply be slid along tube 10 until it is clamped against the exterior wall of container 100, as explained at length above, all without removing the components from their packaging. Once installed, the packaging may be removed and discarded, and a sterile hose, tube, or other connection from a dispensing apparatus may then be attached to the free end of elongate tube 10 to complete the sterile, fluid-tight connection.

The invention has been described with references to a preferred embodiment. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with such underlying concept. It is intended to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

What is claimed is:

1. A self-sealing dispensing tap, comprising:

an elongate tube having a generally rigid exterior wall, said elongate tube comprising:

a penetrating end; and a hinge stop encircling said exterior wall adjacent said penetrating end;

a hinge plate attached to said tube adjacent said hinge stop, said hinge plate comprising:

a ring plate having an inner diameter sized to enable application of said hinge plate over said elongate tube; and a plurality of fingers affixed to the outer circumference of said ring plate;

a compression plate, comprising:

a disc having a centrally located opening sized and configured to enable application of said disc over said elongate tube; and a lock positioned an axial distance away from said hinge stop on the side of said hinge stop opposite said penetrating end.

2. The self-sealing dispensing tap of claim 1, further comprising:

a sealing ring sized and configured to enable application of said sealing ring over said elongate tube between said compression plate and said hinge plate.

3. The self-sealing dispensing tap of claim 2, said sealing ring being formed of a flexible material.

4. The self-sealing dispensing tap of claim 3, said sealing ring further comprising:

a sealing disc having a centrally located opening configured with an opening diameter that is smaller than the outer diameter of said elongate tube.

5. The self-sealing dispensing tap of claim 2, wherein said sealing ring forms a barrier around the exterior of said elongate tube.

6. The self-sealing dispensing tap of claim 1, said penetrating end of said elongate tube further comprising:

an angled face defining a piercing tip.

7. The self-sealing dispensing tap of claim 1, said penetrating end of said elongate tube further comprising:

a pair of sharpened edges formed in a top and bottom portion of the wall of said elongate tube.

8. The self-sealing dispensing tap of claim 7, further comprising:

a pair of knife edges, each said knife edge extending along the outside of the wall of said elongate tube in a direction substantially parallel to the major axis of said tube, the radial dimension of said knife edge diminishing as it approaches said penetrating end of said elongate tube.

9. The self-sealing dispensing tap of claim 8, wherein the maximum diameter of each said knife edge begins adjacent said hinge stop.

10. The self-sealing dispensing tap of claim 1, wherein each said hinge finger is sufficiently flexible to enable each said hinge finger to be pivoted with respect to said ring plate.

11. The self-sealing dispensing tap of claim 1, wherein each said hinge finger is only partially attached to the outer circumference of said ring plate.

12. The self-sealing dispensing tap of claim 11, each said hinge finger further comprises:

an end wall adjacent said ring plate wherein said hinge finger is attached to the outer circumference of said ring plate along only a portion of said end wall, the remaining portion of said end wall being detached from the outer circumference of said ring plate.

13. The self-sealing dispensing tap of claim 12, wherein each said hinge finger may be pivoted with respect to said ring plate along the portion of said end wall attached to said ring plate.

14. The self-sealing dispensing tap of claim 1, said lock further comprising:

a lock stop having an angled face at an upper end furthest from the penetrating end of said elongate tube; and a right angle stop at a bottom end of said lock stop.

15. A self-sealing dispensing tap for attaching to a flexible package, said dispensing tap comprising:

an elongate tube having a generally rigid exterior wall, said elongate tube comprising:

a penetrating end; and a hinge stop encircling said exterior wall adjacent said penetrating end;

a hinge plate attached to said tube adjacent said hinge stop, said hinge plate comprising:

a ring plate having an inner diameter sized to enable application of said hinge plate over said elongate tube; and a plurality of fingers affixed to the outer circumference of said ring plate; and a compression plate, comprising:

a disc having a centrally located opening sized and configured to enable application of said disc over said elongate tube; and a lock positioned an axial distance away from said hinge stop on the side of said hinge stop opposite said penetrating end, such that when said hinge plate is flush against an interior wall of said flexible package said lock holds said compression plate against an exterior wall of said flexible package.

16. The self-sealing dispensing tap of claim 15, further comprising:

a sealing ring sized and configured to enable application of said sealing ring over said elongate tube between said compression plate and said hinge plate.

17. The self-sealing dispensing tap of claim 16, said sealing ring being formed of a flexible material.

18. The self-sealing dispensing tap of claim 17, said sealing ring further comprising:

a sealing disc having a centrally located opening configured with an opening diameter that is smaller than the outer diameter of said elongate tube.

19. The self-sealing dispensing tap of claim 17, wherein said sealing ring forms a barrier around the exterior of said elongate tube, such that when said compression plate is locked against the exterior wall of said flexible package, a seal is formed sufficiently tight to prevent product within said flexible package, bacteria, or oxygen from passing between the interior and exterior of said flexible package.

20. The self-sealing dispensing tap of claim 15, said penetrating end of said elongate tube further comprising:

an angled face defining a piercing tip.

21. The self-sealing dispensing tap of claim 15, said penetrating end of said elongate tube further comprising:

a pair of sharpened edges formed in a top and bottom portion of the wall of said elongate tube.

22. The self-sealing dispensing tap of claim 21, further comprising:

a pair of knife edges, each said knife edge extending along the outside of the wall of said elongate tube in a direction substantially parallel to the major axis of said tube, the radial dimension of said knife edge diminishing as it approaches said penetrating end of said elongate tube.

23. The self-sealing dispensing tap of claim 22, wherein the maximum diameter of each said knife edge begins adjacent said hinge stop.

24. The self-sealing dispensing tap of claim 15, wherein each said hinge finger is sufficiently flexible to enable each said hinge finger to be pivoted with respect to said ring plate.

25. The self-sealing dispensing tap of claim 15, wherein each said hinge finger is only partially attached to the outer circumference of said ring plate.

26. The self-sealing dispensing tap of claim 25, each said hinge finger further comprising:

an end wall adjacent said ring plate wherein said hinge finger is attached to the outer circumference of said ring plate along only a portion of said end wall, the remaining portion of said end wall being detached from the outer circumference of said ring plate.

27. The self-sealing dispensing tap of claim 26, wherein each said hinge finger may be pivoted with respect to said ring plate along the portion of said end wall attached to said ring plate.

28. The self-sealing dispensing tap of claim 15, said lock further comprising:

a lock stop having an angled face at its upper end furthest from the penetrating end of said elongate tube; and a right angle stop at its bottom end.

29. The self-sealing dispensing tap of claim 15, said lock further comprising:

a plurality of protrusions extending radially outward from said elongate tube and circumferentially aligned along the exterior of said tube, wherein said compression plate is provided at its centrally located opening with a plurality of radial slots extending into the interior wall of said compression plate.

30. The self-sealing dispensing tap of claim 29, wherein said plurality of slots are sized and configured so as to enable said compression plate to pass over said lock when said slots and protrusions are axially aligned.

31. The self-sealing dispensing tap of claim 29, wherein said plurality of slots are sized and configured so that when said compression plate is rotated about the central axis of said elongate tube said slots and protrusions are axially misaligned, holding said compression plate against an exterior wall of said flexible package.

32. The self-sealing dispensing tap of claim 31, wherein said plurality of slots are sized and configured so that when said compression plate is rotated about the central axis of said elongate tube said slots and protrusions are axially misaligned, preventing said compression plate from traveling along said elongate tube.

* * * * *